US007105262B2

(12) United States Patent
Takano et al.

(10) Patent No.: US 7,105,262 B2
(45) Date of Patent: Sep. 12, 2006

(54) LIQUID DEVELOPER

(75) Inventors: Hidehiro Takano, Nagano (JP); Tahei Ishiwatari, Nagano (JP); Takuya Kadota, Nagano (JP); Rie Miyazaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 188 days.

(21) Appl. No.: 10/751,123

(22) Filed: Jan. 5, 2004

(65) Prior Publication Data

US 2005/0003293 A1 Jan. 6, 2005

(30) Foreign Application Priority Data

Jan. 8, 2003 (JP) ..... 2003-002222

(51) Int. Cl.
*G03G 9/135* (2006.01)

(52) U.S. Cl. ..... 430/115; 430/114

(58) Field of Classification Search ..... 430/115, 430/114

See application file for complete search history.

(56) References Cited

U.S. PATENT DOCUMENTS 5,378,574 A * 1/1995 Winnik et al. ..... 430/115

6,372,402 B1 * 4/2002 Pan et al. ..... 430/115

FOREIGN PATENT DOCUMENTS

JP 03-043749 A 2/1991

* cited by examiner

*Primary Examiner*—Christopher Rodee
(74) *Attorney, Agent, or Firm*—Sughrue Mion, PLLC

(57) ABSTRACT

The invention provides a liquid developer that is used in an apparatus for forming an image by developing an electrostatic latent image formed on a latent image carrying member, transferring the developed image to a recording medium, and then fixing the image, in which the liquid developer contains a carrier liquid and particles formed with a composition containing a binder resin, a colorant, and a charge controlling agent comprising a charge controlling substance containing an ionic or neutral substance, wherein the charge controlling substance containing an ionic or neutral substance is supported by an inorganic porous material.

11 Claims, 1 Drawing Sheet

LIQUID DEVELOPER

FIELD OF THE INVENTION

The present invention relates to a liquid developer used for forming an image by developing an electrostatic latent image formed on a latent image carrying member, with a liquid developer.

BACKGROUND OF THE INVENTION

A developer used for developing an electrostatic latent image formed on a latent image carrying member is classified into one for a method using a dry toner, in which a toner containing a colorant, such as a pigment, and a binder resin in a dry state, and another for a method using a liquid developer containing an insulating carrier liquid and a toner dispersed therein.

The method using a dry toner is advantageous in handleability since only a toner in a solid state is handled, but involves problems in contamination due to scattering of a toner and in uniformity upon dispersing a toner.

In the method using a liquid developer containing an insulating carrier liquid and a toner dispersed therein, on the other hand, fine toner particles can be used, and therefore, it is excellent in reproducibility of a thin line image, gradation and color. Furthermore, it is also excellent as a high-speed image forming method.

A liquid developer contains an insulating carrier liquid having dispersed therein a toner, which is formed by kneading a binder resin with a colorant, such as a pigment, and a charge controlling agent for improving the charge characteristics of the toner.

While various kinds of liquids have been known as the insulating carrier liquid for the liquid developer, an isoparaffin has been known as a carrier liquid that is safe and good in handleability, and the use of a silicone oil has been proposed as a carrier liquid that can be applied to wide range of photoreceptors (as described, for example, in Japanese Patent Application Laid-Open No. 43749/1991).

The liquid developer involves such a problem in that the charge controlling agent present in the vicinity of the surface of the toner particles is liable to be dissolved in the carrier liquid to reduce the function of the charge controlling agent.

In the process for forming the toner particles, furthermore, the charge controlling agent may sublime or suffer oxidative decomposition upon processing the kneaded binder resin under heat or upon drying the particles under heat or reduced pressure after forming the particles in the liquid. As a result, the electrostatic charge of the toner is liable to be ununiform to cause problems in fogging and transferring failure due to inverse charge.

SUMMARY OF THE INVENTION

The above-described problems can be solved by a liquid developer used in an apparatus for forming an image by developing an electrostatic latent image formed on a latent image carrying member, transferring the developed image to a recording medium, and then fixing the image, wherein the liquid developer contains a carrier liquid and particles being dispersed therein and formed with a composition containing a binder resin, a colorant, and a charge controlling agent containing a charge controlling substance supported by an inorganic porous material, wherein the charge controlling substance comprises an ionic or neutral substance.

In a preferred embodiment of the invention, the carrier liquid is at least one member selected from the group consisting of a silicone oil and an isoparaffin.

In the liquid developer according to the invention, the charge controlling agent contains the charge controlling substance supported by the inorganic porous material, in which the charge controlling substance contains the ionic or neutral substance. Then the charge controlling substance is stably retained in the inorganic-porous material. Therefore, the charge controlling substance present in the vicinity of the surface of the toner particles can be prevented from being dissolved into the carrier liquid to deteriorate the charge characteristics.

Furthermore, according to the charge controlling agent of the invention, the ionic substance or the neutral substance used as the charge controlling substance can be reduced in such an amount that is lost upon processing under heat or reduced pressure in the production of the toner particles due to sublimation or oxidative decomposition. Accordingly, the charge characteristics can be prevented from being ununiform to obtain a toner excellent in charge characteristics.

DETAILED DESCRIPTION OF THE INVENTION

Figure 1:
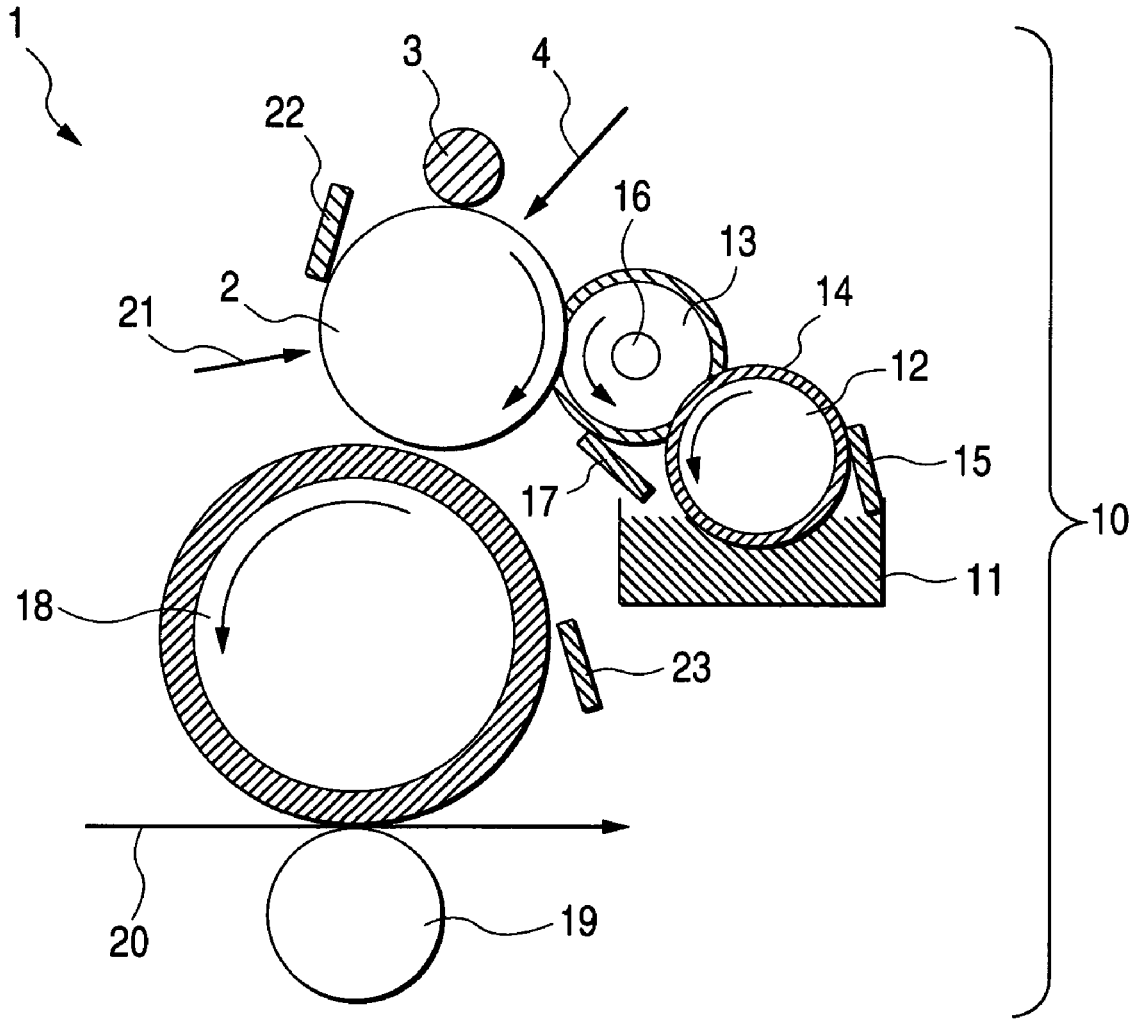
FIG. 1 is a schematic cross sectional view showing an example of an image forming apparatus using the liquid developer according to the invention.

The liquid developer of the invention is used in an apparatus for forming an image by developing an electrostatic latent image formed on a latent image carrying member, transferring the developed image to a recording medium, and then fixing the image. The liquid developer contains a carrier liquid having dispersed therein particles formed with a composition containing a binder resin, a colorant, and a charge controlling agent containing a charge controlling substance supported by the inorganic porous material, in which the charge controlling substance contains the ionic or neutral substance. Therefore, the charge controlling substance is stably retained on the inorganic porous material.

Therefore, the charge controlling substance is stably present in the toner particles even in the case where the particles suffers at least one of steps of heating and reducing in pressure after forming the particles in the process of depositing the toner particles in a liquid or in the process of kneading under heat. Therefore, the charge characteristics are stabilized to obtain a liquid developer that does not form a fogging toner or an inversely charged toner. Moreover, the amount of the toner remaining on the latent image carrying member after transferring can be reduced in the case where an electrostatic latent image formed on the latent image carrying member is developed.

Accordingly, the inorganic porous material, such as silicate and silica, used as a carrier for the charge controlling substance has functions of dispersing in a binder resin and imparting electrostatic charge, and fine pores formed on the surface thereof attain a charge controlling function owing to the charge controlling substance residing therein. The charge controlling substance is present inside the fine pores and adsorbed to or protected by the inorganic porous material. Therefore, the charge controlling substance is suppressed in sublimation and decomposition under heat or reduced pressure in the production process.

It is considered, therefore, that the ionic or neutral substance used as the charge controlling substance is supported by the inorganic porous material even in any of the case where the toner is formed into particles by pulverizing a composition formed by kneading in a closed system with a biaxial extruding kneader or the like, the case where the toner is formed into particles by putting the composition into a liquid, or the case where the toner having been formed into particles by removing a solvent under heat or reduced pressure is dispersed in the carrier liquid, so as to prevent sublimation and oxidative decomposition of the charge controlling substance, whereby the charge controlling substance is present stably and uniformly, and thus such functions can be obtained as reduction of fogging and reduction of an inversely charged toner.

Furthermore, it is considered that the inorganic porous material functioning as a carrier for the charge controlling substance has large affinity to a silicone oil and an aliphatic liquid, such as an isoparaffin, to enhance dispersion of the toner in the carrier liquid and to suppress sedimentation of solid contents in the carrier liquid. Furthermore, it also does not adversely affect on the solubility of the toner in the carrier liquid, whereby a stable liquid developer can be provided.

As described in the foregoing, the charge controlling agent contained in the toner of the liquid developer of the invention is characterized by containing a charge controlling substance in the inorganic porous material.

Examples of the inorganic porous material include silica gel, montmorillonite, bentonite, hectorite, kaolinite, serpentinite, talc, pyrophyllite, feldspar, zeolite, wollastonite and fibrolite, and at least one of them may be used.

The size of the inorganic porous material that is put in the kneading process is preferably from 5 to 100 μm, and more preferably from 30 to 70 μm of number average particle size.

In the case where the size is larger than 100 μm, it is not preferred since unevenness is formed on the surface of the toner mother particles upon production, and in the case where it is smaller than 5 μm, it is also not preferred since fine pores are not completely formed, and the charge controlling substance cannot be carried therein.

The diameter of the fine pores is preferably from 0.05 to 10 nm. In the case where it is less than 0.5 nm, the charge controlling substance is difficult to retain therein, and in the case where it exceeds 10 nm, the charge controlling agent is liable to be released therefrom.

The charge controlling agent of the invention can be provided the inorganic porous material by processing the inorganic porous material with a solution containing the charge controlling substance in a predetermined concentration, whereby the charge controlling substance can be supported by the inorganic porous material. Examples of the charge controlling substance include oil black, oil black BY, Bontron S-22 and S-34 (produced by Orient Chemical Industries, Ltd.), salicylic acid metallic complex E-81 and E-84 (produced by Orient Chemical Industries, Ltd.), a thioindigo pigment, a sulfonylamine derivative of copper phthalocyanine, Spilon Black TRH (produced by Hodogaya Chemical Co., Ltd.), a calixarene compound, an organic boron compound, a fluorine-containing quaternary ammonium salt compound, a monoazo metallic complex, an aromatic hydroxycarboxylic acid metallic complex, an aromatic dicarboxylic acid metallic complex and a polysaccharide.

Examples of the carrier liquid for the liquid developer of the invention include an aliphatic hydrocarbon, such as an isoparaffin, e.g., Isopar, and a silicone oil.

In particular, a silicone oil is excellent as the carrier liquid since it is table to an organic photoreceptor, and is suitable for high-speed duplication and duplication in a large amount.

Examples of the silicone oil include dimethylpolysiloxane, phenylmethyl silicone oil obtained by substituting at least one methyl group of dimethylpolysiloxane with a phenyl group, and a cyclic dimethylpolysiloxane oil.

A synthetic resin that has been used as a binder resin for toners and is not dissolved in the carrier liquid can be used as the binder resin. Examples thereof include a styrene resin including a homopolymer and copolymer containing styrene or a substituted styrene, such as polystyrene, poly-α-methylstyrene, chloropolystyrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylic ester copolymer, a styrene-methacrylic ester copolymer, a styrene-acrylic ester-methacrylic ester copolymer, a styrene-α-chloromethyl acrylate copolymer, a styrene-acrylonitrile-acrylic ester copolymer and a styrene-vinyl methyl ether copolymer, a polyester resin, an epoxy resin, a urethane-modified epoxy resin, a silicone-modified epoxy resin, a vinyl chloride resin, a rosin-modified maleic acid resin, a phenyl resin, polyethylene, polypropylene, an ionomer resin, a polyurethane resin, a silicone resin, a ketone resin, an ethylene-ethyl acrylate copolymer, a xylene resin, a polyvinyl butyral resin, a terpene resin, a phenol resin, and an aliphatic or alicyclic hydrocarbon resin. These binder resins may be used either solely or in combination.

The urethane resin that can be used in the invention has a urethane bond or a urea bond and can be obtained by bulk polymerization of a polyisocyanate and a compound having plural active hydrogen groups.

Examples of the polyisocyanate include an aliphatic diisocyanate, an aliphatic diisocyanate having a cyclic group, an aromatic diisocyanate, a naphthalene diisocyanate, a biphenyl diisocyanate, a di- or triphenylmethane diisocyanate and a di- or triphenylethane diisocyanate, a triisocyanate and an alicyclic diisocyanate.

Examples of the compound having plural active hydrogen groups include a polyol and a polyamine.

Examples of the aliphatic diisocyanate include ethane diisocyanate, propane diisocyanate, butene diisocyanate, butane diisocyanate, thiodiethyl diisocyanate, pentane diisocyanate, β-methylbutane diisocyanate, hexane diisocyanate, ω,ω'-dipropyl ether diisocyanate, thiodipropyl diisocyanate, heptane diisocyanate, 2,2-dimethylpentane diisocyanate, 3-methoxyhexane diisocyanate, octane diisocyanate, 2,2,4-trimethylpentane diisocyanate, nonane diisocyanate, decane diisocyanate, 3-butoxyhexane diisocyanate, 1,4-butylene glycol dipropyl ether-ω,ω'-diisocyanate, undecane diisocyanate, dodecane diisocyanate and thiodihexyl diisocyanate.

Examples of the aliphatic diisocyanate having a cyclic group include ω,ω'-1,3-dimethylbenzene diisocyanate, ω,ω'-1,2-dimethylbenzene diisocyanate, ω,ω'-1,2-dimethylcyclohexane diisocyanate, ω,ω'-1,4-dimethylcyclohexane diisocyanate, ω,ω'-1,4-diethylbenzene diisocyanate, ω,ω'-1,4-dimethylnaphthalene diisocyanate, ω,ω'-1,5-dimethylnaphthalene diisocyanate, 3,5-dimethylcyclohexane-1-methylisocyanate-2-propyl isocyanate and ω,ω'-n-propylbiphenyl diisocyanate.

Examples of the aromatic diisocyanate include 1,3-phenylene diisocyanate, 1,4-phenylene diisocyanate, 1-methylbenzene-2,4-diisocyanate, 1-methylbenzene-2,5-diisocyanate, 1-methylbenzene-3,5-diisocyanate, 1,3-dimethylbenzene-2,4-diisocyanate, 1,3-dimethylbenzene-4,6-diisocyanate, 1,4-dimethylbenzene-2,5-diisocyante, 1-ethylbenzene-2,4-diisocyanate, 1-isopropylbenzene-2,4-diisocyanate, diethylbenzene diisocyanate and diisopropylbenzene diisocyanate.

Examples of the naphthalene diisocyanate include naphthalene-1,4-diisocyanate, naphthalene-2,5-diisocyanate, naphthalene-2,6-diisocyante, naphthalene-2,7-diisocyanate and 1,1'-dinaphthyl-2,2'-diisocyanate.

Examples of the biphenyl diisocyanate include biphenyl-2,4'-diisocyanate, biphenyl-4,4'-diisocyanate, 3,3'-dimethylbiphenyl-4,4'-diisocyanate, 3,3'-dimethoxybiphenyl-4,4'-diisocyanate and 2-nitrobiphenyl-4,4'-diisocyanate.

Examples of the di- or triphenylmethane diisocyanate and the di- or triphenylethane diisocyanate include diphenylmethane-4,4'-diisocyanate, 2,2'-dimethyldiphenylmethane-4,4'-diisocyanate, diphenyldimethylmethane-4,4'-diisocyanate, 2,5,2',5'-tetramethyldiphenylmethane-4,4'-diisocyanate, 3,3'-dimethoxydiphenylmethane-4,4'-diisocyanate, 4,4'-dimethoxyphenylmethan-3,3'-diisocyanate, 4,4'-diethoxyphenylmethane-3,3'-diisocyanate, 2,2'-dimethyl-5,5'-dimethoxydiphenylmethane-4,4'-diisocyanate, 3,3-dichlorodiphenyldimethylmethane-4,4'-diisocyanate, benzophenone-3,3'-diisocyanate, α,β-diphenylethane-2,4-diisocyanate, 3-nitrotriphenylmethane-4,4'-diisocyanate, 4-nitrotriphenylmethane-4,4'-diisocyanate, and derivatives thereof.

Examples of the triisocyanate include 1-methylbenzene-2,4,6-triisocyanate, 1,3,5-trimethylbenzene-2,4,6-triisocyanate, naphthalene-1,3,7-triisocyanate, biphenyl-1,3,7-triisocyanate, diphenylmethane-2,4,4'-triisocyanate, 3-methyldiphenylmethane-4,6,4'-triisocyanate, triphenylmethane-4,4',4"-triisocyanate, diphenyl-4,4'-diisocyanatocarbamic acid chloride, and derivatives thereof.

When a diisocyanate represented by the general formula shown below is used, polyurethane excellent in pulverization property can be obtained and thus the productivity in the pulverization process upon producing the toner particles:

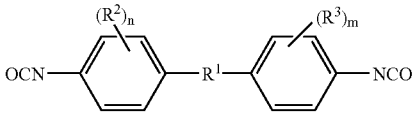

wherein $R^1$ represents an alkylene group selected from a methylene group, an ethylene group and a —$C(CH_3)_2$— group; $R^2$ and $R^3$ each independently represents a group selected from an alkyl group having 4 or less carbon atoms, an alkoxy group having 4 or less carbon atoms and a halogen atom; m and n each independently represents an integer of from 0 to 4; and when m and/or n represents 2 or more, plural $R^2$s and/or $R^3$s may be the same or different from one another.

Specific examples of the diisocyanate represented by the aforementioned general formula include diphenylmethane-4,4'-diisocyanate, 2,2'-dimethyldiphenylmethane-4,4'-diisocyanate, 2,2'5,5'-tetramethyldiphenylmethane-4,4'-diisocyanate, 3,3'-dimethoxydiphenylmethane-4,4'-diisocyanate, 2,2'-dimethyl-5,5'-dimethoxydiphenylmethane-4,4'-diisocyanate, 3,3'-dichlorodiphenylmethane-4,4'-diisocyanate, α,β-diphenylethane-4,4'-diisocyanate, and derivatives thereof. Mixtures of a plurality of these polyisocyanate may be preferably used.

The aforementioned polyisocyanate has a structure containing two aromatic rings bonded through an alkylene group as a basic skeleton. It is considered that the flexibility of the molecular chain of the binder polymer can be reduced to provide a rigid structure by using the polyisocyanate compound as a component, whereby the pulverization property is improved.

In the case where the alicyclic diisocyanate compound is used as the polyisocyanate, a toner can be obtained that is excellent in light fastness to prevent an image from being discolored upon long-term storage. It is considered that deterioration due to light and heat can be suppressed because an alicyclic diisocyanate has an alicyclic hydrocarbon structure. A urethane resin thus obtained is excellent in pulverization property owing to a structure having large rigidity, and thus excellent in the productivity in the pulverization process and excellent in the classification process upon producing the toner.

An alicyclic diisocyanate compound has such a structure containing an alicyclic hydrocarbon or a polyalicyclic hydrocarbon and two isocyanate groups bonded thereto directly or via an alkylene group. Examples thereof include isophorone diisocyanate represented by the following formula:

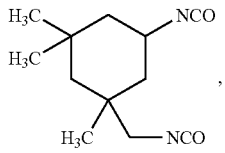

,

ω,ω'-1,2-dimethylcyclohexane diisocyanate, ω,ω'-1,4-dimethylcyclohexane diisocyanate and 3,5-dimethylcyclohexane-1-methylisocyanate-2-propylisocyanate.

The polyalicyclic diisocyanate represented by the following general formula:

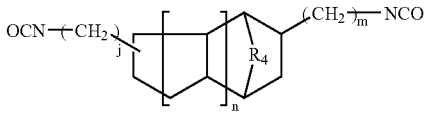

wherein R4 represents a group selected from a single bond, a methylene group, an ethylene group or a —$C(CH_3)_2$— group, j and m each represents an integer of from 1 to 5, and n represents an integer of from 0 to 2, are also preferred. Examples thereof include norbornane diisocyanate represented by the following formula:

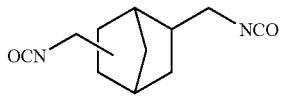

The urethane resin used in the invention can be produced by bulk polymerization of a polyisocyanate and a compound having plural active hydrogen groups. Examples of the polyisocyanate include, from the viewpoint of the pulverization property of the toner and the fixing strength to a recording medium, a diisocyanate having an alicyclic hydrocarbon or an aromatic hydrocarbon is preferred, such as diphenylmethane-4,4'-diisocyanate (MDI), isophorone diisocyanate (IPDI), norbornane diisocyanate (NBDI), dicyclohexylmethane-4,4'-diisocyanate (hydrogenated MDI), p-xylylene diisocyanate, m-xylylene diisocyanate (XDI), p-phenylene diisocyanate, p-tetramethylxylylene diisocyanate, m-tetramethylxylylene diisocyanate, 1,5-naphthalene diisocyanate, triphenylmethane triisocyanate, 1,3-bis(isocyanatomethyl)cyclohexane (hydrogenated XDI) and 2,4-tolylene diisocyanate (TDI), and mixture of two or more of these polyisocyanatesmay be used in combination.

Among these, diphenylmethane 4,4'-diisocyanate (MDI) is particularly preferred.

The polyol and the polyamine to be reacted with the polyisocyanate will next be described. A bulky component with a low degree of freedom disturbing crystallinity of polyurethane, which is obtained by using an active hydrogen compound having at least two active hydrogen groups, is preferably used in the invention, whereby the pulverization property upon production and the fixing strength to a recording medium, such as paper, are improved while maintaining the low temperature fixing property and the offset resistance of the urethane resin toner.

Examples of the active hydrogen compound having at least two active hydrogen groups include an alicyclic polyol and an alicyclic polyamine. Examples of the alicyclic polyol include ,4-cyclohexanedimethanol and 1,4-cyclohexanediol, and examples of the alicyclic polyamine include 1,4-cyclohexanedimethylamine and 1,4-cyclohexanediamine.

In order to impart desired melting characteristics to the toner, a compound represented by the general formula (1) shown below is preferably used in combination with the alicyclic polyol or the alicyclic polyamine:

(1)

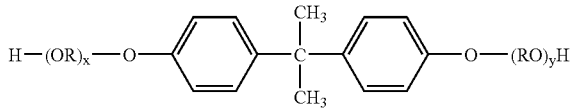

wherein R represents an alkylene group, preferably an ethylene group or an propylene group; and x and y each represents an integer of 1 or more.

Examples of the compound represented by the foregoing general formula (1) include a polyoxyalkylene bisphenol A ether compounds such as 2 to 12 moles ethylene oxide adducts of bisphenol A (hereinafter, referred to as "EO adducts") and 2 to 12 moles propylene oxide adducts of bisphenol A (hereinafter, referred to as "PO adducts"), which may be used either solely or in combination. It is also possible to use, as a mixture, two or more compounds having different repeating numbers of EO groups or PO groups. In the case where they are used as a mixture, the mixing ratio (molar ratio) thereof (EO adduct:PO adduct) is generally 8:2 to 1:9, preferably from 8:2 to 2:8, and more preferably from 7:3 to 4:6.

In the general formula (1), plural groups represented by R may be the same as or different from each other, and one may be an ethylene group while another may be a propylene group. The physical property of the binder polymer varies depending on the repeating number of EO groups and PO groups. The average value of x+y is generally from 2 to 12, and preferably from 2 to 4. In the case where the repeating number exceeds 12, it is not preferred since it causes reduction of the glass transition temperature and deterioration of the pulverization property, and in the case where the repeating number is too small, the strength, particularly bending and peeling strength lowered. The fixing strength (bending and peeling strength) can be improved by increasing the compositional ratio of the EO component, but it causes reduction of the glass transition temperature and deterioration of the pulverization property. On the other hand, the pulverization property can be improved by increasing the compositional ratio of the PO component, but the fixing strength (bending and peeling strength) lowered. The hydroxyl group value of the polyoxyalkylene bisphenol A ether compound is from 100 to 350 KOHmg/g, and preferably from 200 to 290 KOHmg/g. It is considered that the polyoxyalkylene bisphenol A ether compound has a bisphenol A as a basic skeleton, then that has a structure having a molecular chain with small degree of freedom and large rigidity, when reacted with polyisocyanate into binder polymer.

The polyoxyalkylene bisphenol A ether represented by the general formula (1) is desirably added in an amount of from 10 to 10000 mole, preferably from 100 to 2000 mole, and more preferably from 200 to 1000 mole, per 100 mole of the alicyclic polyol or the alicyclic polyamine, whereby the pulverization property upon producing the toner, the low temperature fixing property, the offset resistance at high temperatures and the fixing strength can be improved, and the softening point (Tm) and the glass transition temperature (Tg) can be easily adjusted.

Other polyols may be added in such a range that does not the properties of the toner produced with the active hydrogen compound having plural active hydrogen groups, such as polyethylene glycol, polypropylene glycol, polytetramethylene glycol, poly(caprolactonepolyol), poly(hexamethylene carbonate) and bis(2-hydroxyethyl) terephthalate.

When the polyisocyanate is reacted with the active hydrogen compound, a ratio (NCO/active hydrogen (equivalent ratio)) of the number of the isocyanate groups of the polyisocyanate compound with respect to the number of the active hydrogen groups in the active hydrogen compound is adjusted to fall within the range of from 0.5 to 1.0, and preferably from 0.7 to 1.0. The reaction may be carried out by bulk polymerization at a temperature of from 30 to 180° C., and preferably from 30 to 140° C., under the atmospheric pressure with no solvent for a period of from several minutes to several hours. Examples of a catalyst include dibutyltin dichloride, dimethyltin dichloride, tin octylate, triphenylammonium dichloride, triethylamine, N,N-dimethylcyclohexylamine, triethylenediamine, dimethylaminoethanol, dioctyltin dilaurate, dioctyltin dineodecanoate and dibutyltin bis (ester mercaptate).

The reaction of the polyisocyanate and the active hydrogen compound can be carried out with no solvent. Therefore, the reaction requires no solvent, which is used in solvent polymerization, and causes no by-product, which is formed in polycondensation reaction, whereby efficient continuous production is realized.

In the case where the urethane resin is used as a binder resin, the binder resin may contain a resin having a urethane bond or a urea bond as a main component, and may also contain other binder resin in an amount of less than 50 wt. % based on the total amount of the binder resin and in such an amount that does not impair the properties of the main component. The "other binder resin" may coexist upon production of the binder resin of the invention, or may be kneaded after the production. In the case where the "other binder resin" coexists upon production of the binder resin of the invention, such a resin is preferred that contains no group reacting with the polyisocyanate. Examples of the "other binder resin" include those binder resins having been mentioned, such as polystyrene.

As the colorant of the toner of the invention, a colorant for toners may be used. Examples thereof include dyes and pigments such as carbon black, lamp black, magnetite, titanium black, chrome yellow, ultramarine, aniline blue, phthalocyanine blue, phthalocyanine green, Hansa Yellow G, Rhodamine 6G, Calco Oil Blue, quinacridone, benzidine yellow, rose bengal, malachite green lake, quinoline yellow, C.I. Pigment Red 48:1, C.I. Pigment Red 122, C.I. Pigment Red 57:1, C.I. Pigment Red 184, C.I. Pigment Yellow 12, C.I. Pigment Yellow 17, C.I. Pigment Yellow 97, C.I. Pigment Yellow 180, C.I. Pigment Yellow 162, C.I. Pigment Blue 5:1 and C.I. Pigment Blue 15:3, which may be used either solely or in combination.

A releasing agent for toners may be used as a releasing agent in the invention. Examples thereof include paraffin wax, micro wax, microcrystalline wax, candelilla wax, carnauba wax, rice wax, montan wax, ester wax, polyethylene wax, polypropylene wax, oxidized polyethylene wax and oxidized polypropylene wax. Among these, polyethylene wax, polypropylene wax, carnauba wax and ester wax are preferably used.

With respect to 100 parts by weight of the binder resin, the colorant is added in an amount of from 0.5 to 15 parts by weight, and preferably from 1 to 10 parts by weight, the releasing agent is added in an amount of from 1 to 10 parts by weight, and preferably from 2.5 to 8 parts by weight, and the charge controlling agent is generally used in an amount of from 0.1 to 7 parts by weight, and preferably from 0.5 to 5 parts by weight.

The toner preferably has a number average particle size of 8 μm or less, and more preferably from 0.3 to 5 μm. When a toner having a particle diameter exceeding 8 μm is used, the reproducibility of the high resolution inferior to a toner having a smaller particle diameter even if a latent image is formed with a high resolution of 1,200 dpi or more, and a toner having a particle diameter of less than 0.3 μm is not preferred since the hiding power of the toner is lowered.

FIG. 1 is a schematic cross sectional view showing an example of an image forming apparatus using the liquid developer according to the invention.

An image forming apparatus 1 has a cylindrical photoreceptor drum 2. The surface of the photoreceptor 2 is uniformly charged with a charging device 3 formed with epichlorohydrin rubber or the like, and then subjected to exposure 4 corresponding to information to be recorded with a laser diode or the like to form an electrostatic latent image.

A developing device 10 has, inside a developer vessel 11, a coating roller 12, a part of which is immersed in a developer, and a developing roller 13, and the coating roller 12 is a metallic gravure roller, such as stainless steel, rotating as opposed to the developing roller.

A liquid developer coating layer 14 is formed on the surface of the coating roller, and the thickness thereof is maintained to a constant value with a metering blade 15.

The liquid developer is transferred from the coating roller 12 to the developing roller 13. The developing roller 13 has a low hardness silicone rubber layer on a metallic roller core 16, such as stainless steel, and resin layer formed with an electroconductive PFA (polytetrafluoroethylene-perfluorovinyl ether copolymer) is provided on the surface thereof. The developing roller rotates at the same velocity as the photoreceptor 2 to transfer the liquid developer to a part having the latent image.

The liquid developer remaining on the developing roller 13 after transferring to the photoreceptor 2 is removed with a developing roller cleaning blade 7 and recovered to the developer vessel 11.

After transferring a toner image thus formed on the photoreceptor 2 to an intermediate transfer roller 18, a transfer electric current is applied to a secondary transfer roller 19, whereby the toner image is transferred to an information recording medium 20, such as paper, passing between the rollers, followed by fixing the toner image thus transferred.

After transferring the toner image from the photoreceptor to the intermediate transfer roller, the photoreceptor is uncharged by uncharging light 21, and the toner remaining on the photoreceptor after transferring is removed with a cleaning blade 22 formed with urethane rubber or the like.

Similarly, after transferring the toner image from the intermediate transfer roller 18 to the information recording medium 20, the toner remaining on the intermediate transfer roller 18 after transferring is removed with a cleaning blade 23 formed with urethane rubber or the like.

While formation of an image with a monochrome toner has been described, in the case where an image is formed with color toners of plural colors, a color image can be formed by forming images of the colors with plural developing devices for the respective colors.

EXAMPLES

The invention will be described with reference to the following examples and comparative examples.

Preparation of Charge Controlling Agent 1

100 g of zeolite (volume average particle size: 60 μm, specific surface area by BET method: 130 $m^2/g$) was dispersed in 500 ml of toluene, to which 50 g of a charge controlling substance 1 (polysaccharide charge controlling substance NCA, produced by Clariant Co., Ltd.) was added, then stirring at 50° C. for 2 hours, to prepare a suspension. A solid content was filtered from the resulting suspension and dried. The dried solid content was allowed to stand under the ordinary pressure at 120° C. for 3 hours and then pulverized with a mill to obtain powder having a volume average particle size of 80 μm.

Preparation of Charge Controlling Agent 2

100 g of alkaline bentonite (volume average particle size: 40 μm, specific surface area by BET method: 210 $m^2/g$) was dispersed in water and adjusted to neutral pH with sulfuric acid, and then 50 g of a charge controlling substance 2 (zinc di-t-butyl salicylate, Bontron E-84, produced by Orient Chemical Industries, Ltd.) was added thereto, then stirring at 60° C. for 2 hours to prepare a suspension. Thereafter, a solid content was filtered from the resulting suspension, washed with water and dried. The dried solid content was allowed to stand under reduced pressure at 60° C. for 3 hours and then pulverized with a mill to obtain powder having a volume average particle size of 50 μm.

Preparation of Polyurethane Resin 1

A polyol 1 (PO1) (polyoxyethylene bisphenol A ether (Uniol DA-400, produced by Nippon Oil and Fat Co., Ltd., OH group value: 273 KOHmg/g)) and a polyol 2 (PO2) (dimethylol butanoic acid (DMBA, produced by Nippon Kasei Chemical Co., Ltd., acid value: 375 KOHmg/g, OH group value: 748 KOHmg/g)) were dissolved in each other at a molar ratio PO1:PO2 of 70:30 under heat at 120° C. to prepare a polyol 3 (PO3).

171 g of the polyol 3 (PO3), 129 g of diphenylmethane-4,4'-diisocyanate isocyanate and dioctyltin dilaurate as a catalyst were mixed and dissolved under heat at 120° C., and the mixture was poured into a dish having a dimension of 200 mm×300 mm. The mixture was maintained at 120° C. for 1 hour and then at 130° C. for 5 hours in an air bath to complete the reaction, whereby a polyurethane resin 1 was obtained.

The mixing ratio of the isocyanate component and the polyol (PO3) component (isocyanate component/PO3) was 1/1.27 (a ratio of the number of isocyanate groups to the number of functional groups having active hydrogen capable of reacting with isocyanate).

The glass transition temperature of the polyurethane resin 1 thus obtained was measured with a differential scanning calorimeter (DSC-220C/EXTRA600 PC Station, produced by Seiko Instruments, Inc.). The glass transition temperature Tg was 76° C.

Preparation of Developer 1

80 parts by weight of the polyurethane resin 1, 15 parts by weight of a carbon black pigment (Mogal L, produced by Cabot Oil & Gas Corp.), 2 parts by weight of a releasing agent (Purified Carnauba Wax #1, produced by Nippon Wax Co., Ltd.) and 3 parts by weight of the charge controlling agent 1 as the charge controlling agent were uniformly mixed in a Henschel mixer and coarsely pulverized to a diameter of 2 mm by kneading with a three-roll mill. According to the kneading process, the diameter of the inorganic porous material became 100 nm or less.

10 parts by weight of the resulting mixture was mixed with 90 parts by weight of an isoparaffin (Isopar G, produced by Exxon Corp.), and the mixture was dispersed by circulating by using a dispersing apparatus (Advantis V15, produced by Draiswerke GmBH) under conditions of a bead diameter of 1.0 mm and a flow rate of 20 kg/h. The load power was constantly 3.5 kW.

The particle size of the particle component of the resulting developer was measured with a laser diffraction and scattering particle size distribution measuring apparatus (Microtrack UPA150 model No. 9340, produced by Nikkiso Co., Ltd.), and the number average particle size was 1.3 μm.

Preparation of Developer 2

A developer 2 was produced in the same manner as the preparation of the developer 1 except that a dimethylsilicone oil (100 $mm^2/g$) was used instead of the isoparaffin.

Preparation of Developer 3

A developer 3 was produced in the same manner as in the preparation of the developer 1 except that the charge controlling agent 2 was used instead of the charge controlling agent 1.

Preparation of Comparative Developers

Comparative developers 1 to 3 were prepared in the same manner as in the preparation of the developers 1 to 3 except that the charge controlling agents 1 and 2 were not used, but 1 part by weight of the charge controlling substance and 2 parts by weight of the inorganic fine particles used in the preparation of the charge controlling agents were merely mixed without the adsorption process of the charge controlling substance and the inorganic fine particles carried out in the preparation of the charge controlling agents.

Evaluation of Sedimentation Property

The developer was placed in a 500-ml transparent wide-mouth standard bottle and allowed to stand for 1 month. Thereafter, 50 ml thereof was collected from an upper part of the bottle and a lower part of the bottle, respectively. The solid contents of the samples thus collected were measured, and the sedimentation property was evaluated according to the following equation. The results are shown in Table 1.

$$\text{Sedimentation property} = ((\text{upper part solid content})/(\text{lower part solid content})) \times 100\%$$

Evaluation of Transferring Property

The developer was evaluated in an image forming apparatus shown in FIG. 1 using an amorphous silicon photoreceptor having a diameter of 20 mm charged to a surface potential of 800 V with a charging device having a diameter of 14 mm formed with epichlorohydrin rubber.

A stainless steel gravure roller having a diameter of 20 mm was used as the coating roller, and the coating nip was 1 mm.

The developing roller had a low hardness silicone rubber layer with a JIS A hardness 40° having a diameter of 20 mm formed on a stainless steel core having a diameter of 5 mm, on which an electroconductive PFA tube having a volume resistivity of 105 Ω·cm was covered. The developing bias was 400 V, the developer thickness was 7 μm, and the developing nip was 5 mm.

The intermediate transfer roller had a diameter of 60 mm, on which electroconductive urethane rubber having a volume resistivity of 106 Ω·cm was covered. The primary transfer bias was −400 V.

The secondary transfer roller was epichlorohydrin rubber having a diameter of 24 mm, to which a secondary transfer electric current of −100 μA was applied.

A solid image was printed by using the aforementioned image forming apparatus under conditions where the amount of the attached toner on the photoreceptor was 0.4 $mg/cm^2$, and the apparatus was stopped when the solid image was transferred from the photoreceptor to the intermediate transfer roller.

An adhesive tape (Scotch Mending Tape, produced by Sumitomo 3M, Ltd.) was attached to the downstream of the transfer nip to collect the remaining toner after transferring, and the tape was then attached to high quality paper for PPC (J Paper, produced by Fuji Xerox Office Supply Co., Ltd.). Separately, the original adhesive tape was directly attached to the high quality paper. The colors of the tapes thus attached were measured with a calorimeter (CR-221, produced by Minolta Co., Ltd.) to determine a color difference in the L*a*b* color system. The color difference thus determined was used to represent the transferring property. The smaller the color difference is, the more excellent in the transferring property is. The results are shown in Table 1.

TABLE 1

| | Developer 1 | Developer 2 | Developer 3 | Comparative Developer 1 | Comparative Developer 2 | Comparative Developer 3 |
|---|---|---|---|---|---|---|
| Sedimentation-proof property | 85 | 91 | 76 | 45 | 58 | 51 |
| Transferring property | 0.4 | 0.1 | 0.1 | 4.8 | 2.0 | 1.9 |

The liquid developer of the invention uses a charge controlling agent containing a charge controlling substance inside of the fine pores of an inorganic porous material as a carrier. Accordingly, the charge controlling agent does not suffer from sublimation and oxidative decomposition under heat or reduced pressure in the production process of the toner particles, the amount of the charge controlling agent dissolved into the carrier liquid is small, and the dispersion into the carrier liquid is improved owing to the inorganic porous material.

Consequently, stable charge characteristics can be obtained, whereby formation of an inversely charged toner and formation of fogging are suppressed, and thus an image with high quality can be formed. Furthermore, the sedimentation in the carrier liquid is prevented owing to good dispersion characteristics in the carrier liquid, so as to maintain stable characteristics for a long period of time.

While the present invention has been described in detail and with reference to specific embodiments thereof, it will be apparent to one skilled in the art that various changes and modifications can be made therein without departing the spirit and scope thereof.

The present application is based on Japanese Patent Application No. 2003-2222 filed on Jan. 8, 2003, and the contents thereof are incorporated herein by reference.

What is claimed is:

1. A liquid developer comprising a carrier liquid and particles being dispersed therein and formed with a composition comprising:

a binder resin;

a colorant; and a charge controlling agent comprising a charge controlling substance contained in the pores of an inorganic porous material;

wherein the inorganic porous material has a pore diameter of from 0.05 to 10 nm.

2. The liquid developer according to claim 1, wherein the carrier liquid comprises at least one member selected from the group consisting of a silicone oil and an isoparaffin.

3. The liquid developer according to claim 1, wherein the charge controlling substance comprises an ionic substance or a neutral substance.

4. The liquid developer according to claim 1, wherein the binder resin comprises a urethane resin obtained by bulk polymerization of a polyisocyanate and an active hydrogen compound having plural active hydrogen groups.

5. The liquid developer according to claim 4, wherein the ratio of the number of isocyanate groups of the polyisocyanate compound with respect to the number of active hydrogen groups in the active hydrogen compound is from 0.5 to 1.0.

6. The liquid developer according to claim 4, wherein the polyisocyanate is diphenylmethane 4,4'-diisocyanate.

7. The liquid developer according to claim 4, wherein the active hydrogen compound having plural active hydrogen groups is an alicyclic polyol or an alicyclic polyamine.

8. The liquid developer according to claim 1, wherein the colorant is present in an amount of 0.5 to 15 parts by weight with respect to 100 parts by weight of the binder resin.

9. The liquid developer according to claim 1, wherein the charge controlling agent is present in an amount of from 0.1 to 7 parts by weight with respect to 100 parts by weight of the binder resin.

10. The liquid developer according to claim 1, wherein the composition further comprises a releasing agent.

11. The liquid developer according to claim 10, wherein the releasing agent is presented in an amount of 1 to 10 parts by weight with respect to 100 parts by weight of the binder resin.

* * * * *